US009242661B2

(12) United States Patent
Chadda et al.

(10) Patent No.: US 9,242,661 B2
(45) Date of Patent: Jan. 26, 2016

(54) RAILWAY POINT CRANK SYSTEM

(71) Applicant: SPX International Limited, Leeds (GB)

(72) Inventors: Iqbal Singh Chadda, Bishops Stortford (GB); Todd Christopher Pink, Rockford, IL (US); James Ervin Cooper, Menomonee Falls, WI (US)

(73) Assignee: SPX INTERNATIONAL LIMITED, Water Lane Leeds (GB)

( * ) Notice: Subject to any disclaimer, the term of this patent is extended or adjusted under 35 U.S.C. 154(b) by 198 days.

(21) Appl. No.: 13/901,835

(22) Filed: May 24, 2013

(65) Prior Publication Data

US 2014/0345399 A1 Nov. 27, 2014

(51) Int. Cl.

| | |
|---|---|
| ***B61L 5/02*** | (2006.01) |
| ***B61L 5/04*** | (2006.01) |
| ***B61L 5/06*** | (2006.01) |

(52) U.S. Cl.

CPC ... *B61L 5/02* (2013.01); *B61L 5/04* (2013.01); *B61L 5/06* (2013.01); *B61L 5/065* (2013.01); *Y10T 74/18184* (2015.01)

(58) Field of Classification Search

CPC ..... B61L 5/00; B61L 5/02; B61L 5/04; B61L 5/045; B61L 5/06

USPC ..... 246/218, 257, 262, 435 R, 439, 452

See application file for complete search history.

(56) References Cited

U.S. PATENT DOCUMENTS

| | | | | |
|---|---|---|---|---|
| 1,789,894 | A * | 1/1931 | Coleman | 246/253 |
| 2,130,444 | A * | 9/1938 | Allen et al. | 246/258 |
| 3,842,256 | A | 10/1974 | Crutsch et al. | |
| 4,022,409 | A * | 5/1977 | Ensink et al. | 246/218 |
| 4,428,552 | A * | 1/1984 | Frank et al. | 246/393 |
| 5,531,408 | A * | 7/1996 | Wechselberger | 246/257 |
| 6,062,514 | A * | 5/2000 | McQuistian | 246/218 |
| 6,168,120 | B1 * | 1/2001 | Pease | 246/405 |
| 6,427,950 | B1 * | 8/2002 | Hoyer et al. | 246/257 |
| 6,568,641 | B2 * | 5/2003 | Hoyer et al. | 246/257 |
| 2007/0084973 | A1 * | 4/2007 | Click et al. | 246/452 |
| 2012/0018592 | A1 * | 1/2012 | Guglielmo et al. | 246/258 |

FOREIGN PATENT DOCUMENTS

| | | | |
|---|---|---|---|
| DE | 104882 | C | 8/1899 |
| EP | 0480303 | A3 | 4/1992 |
| EP | 1459954 | A1 | 9/2004 |

(Continued)

OTHER PUBLICATIONS

Search Report for corresponding United Kingdom Patent Application No. GB1309419.8.

(Continued)

*Primary Examiner* — Zachary Kuhfuss
(74) *Attorney, Agent, or Firm* — Baker & Hostetler LLP

(57) ABSTRACT

The present disclosure relates to a linked crank mounting device for use with a switch rail, comprising: an input terminal or series of input terminals; an actuator; an output connector; and attachment means for rigidly attaching the linked crank mounting device relative to the railway; wherein the input terminal or terminals are for receiving input power, the output connector is directly or indirectly mechanically linked to at least one of a switch rail or an output connector of a further linked crank mounting device, and the actuator applies the input power to the output connector.

20 Claims, 9 Drawing Sheets

(56) References Cited

FOREIGN PATENT DOCUMENTS

| | | | |
|---|---|---|---|
| EP | 1524166 | A1 | 4/2005 |
| EP | 1637428 | A1 | 3/2006 |
| EP | 1790548 | A1 | 5/2007 |
| FR | 2974052 | A1 | 10/2012 |

OTHER PUBLICATIONS

International Search Report in corresponding International Application No. PCT/IB2014/001885.

Examination Report under Section 18(3) in Great Britain Patent Application No. 1309419.8 dated Aug. 28, 2015.

* cited by examiner

RAILWAY POINT CRANK SYSTEM

FIELD OF THE INVENTION

The present invention relates to a railway point crank system, and in particular a powered railway point crank system for moving and holding switch rails.

BACKGROUND

Switch rails are present at all railway turn-outs, and allow trains to change tracks. This is achieved by having an extra pair of rails present—the switch rails—which can be moved from a position where they do not interfere with the standard rails and the train wheels, into a position where the train wheels are diverted on to one or more of the switch rails, and so the train is diverted onto the turn-off. The radius of the turn off required (and hence length of the switch rails) varies depending on a number of factors including the terrain and the speed of the train at that section of track.

The switch rails are required to move within strict dimensional limits. Often, the tip of the switch rail is driven into position by a point machine located between, or at the side of the tracks, level with the free end of the switch rails. The force required at this point is exponentially proportional to the length of the switch rail. To ensure the switch rail is located within the required dimensional limits, a series of linked cranks is often employed—with a crank being attached to the switch rail at regular intervals along its length and mechanical linkages connecting all the linked cranks.

In most current linked crank designs, power is transferred from the output of the point operating machine, via the switch rail, to the linked cranks. The point machine moves the tip of the rail, which is connected to a first linked crank, which is thus rotated. This first linked crank is connected to the rest of the linked cranks, and so they all rotate increasingly smaller amounts to ensure the switch rail is located properly. This means that the point machine needs to provide power not only to move the tip of the switch rail, but also all of the linked cranks. This adds significant additional load to the point machine, increasing wear and causing increased incidences of breakdown.

There are new, alternative point machines which address this unreliability somewhat. However these have been expensive to produce, and require a significant amount of work to install, making it expensive, time-consuming and slow to update a significant number of turn-outs with these alternative systems.

SUMMARY OF THE DISCLOSURE

Some embodiments in accordance with the present invention therefore look to resolve these issues to provide a further alternative system that can more cost effectively be implemented.

Some embodiments in accordance with the present invention provide a railway point crank system that provides power directly to the linked cranks, thus reducing the load on the point machine. This is done through a component which is able to be plugged-in and hooked up to existing systems, and can run off of electrical, pneumatic or hydraulic power.

This power can be to apply a torque to the linked cranks. That applied torque is not necessarily enough to rotate the crank. Instead it may be simply to reduce the torque (and hence power) that the point machine is required to output to actuate the linked cranks. This reduces wear and breakdown of point machines.

Some embodiments in accordance with the present invention therefore provide a simple, low-cost and effective solution to the problem of increased wear and breakdowns in point machines, and one that can be readily installed in existing rail systems with minimal overhaul, downtime and expense.

Further, since some embodiments in accordance with the present invention can reduce the number of point machine breakdowns, due to reduced stresses and wear therein, the knock-on effects of such breakdowns, such as delays and cancellations, are also reduced, thus reducing compensation bills for the service provider.

According to some embodiments in accordance with the present invention there is provided a linked crank mounting device for use with a switch rail, including: an input terminal or series of input terminals; an actuator; an output connector; and attachment means for rigidly attaching the linked crank mounting device relative to the railway; wherein the input terminal or terminals are for receiving input power, the output connector is directly or indirectly mechanically linked to at least one of a switch rail or an output connector of a further linked crank mounting device, and the actuator applies the input power to the output connector.

The device is generally in the form of a standalone component which can be installed in an existing system between the power source and the linked cranks (or alternative means for moving and holding the switch rail). As such, the device has input terminals to receive power. Throughout the specification the term input terminals will be used with the understanding that this applies equally to the situation where only a single input terminal is present. These input terminals will vary depending on the type of power received, but will generally be standard industry fittings.

There is little constraint on the location of the input terminals, provided they are accessible for installation and maintenance. As such, the input terminals may be provided on any of the sides, top or even base of the device.

Likewise, an output connector is used to transfer the received power to the linked crank or alternatives. The output connection may take many forms, and is dependent upon the components used to move and hold the switch rail. The output connection is preferably of a form to attach to standard linked cranks presently in use throughout the rail network. Preferably, this is in the form of a square lug, protruding from the top of the device.

Preferably, the output connector has a rotational output. This again is consistent with current installed systems using a rotational linked crank. However, it is foreseen that the output could be a lateral translational movement if required.

Preferably the output connector has a square profile. Other advantageous profiles may include keyway or tapered profiles. However, the output drive can be virtually any profile, as cranks could be adapted to fit any shape of output drive.

While the output connector is said throughout the following specification to be driven in a certain manner, this terminology is not used so as to preclude from protection the situation where the output terminal is not moving, but is subject to a lateral or torsional force. As such, the output connector being driven, or having a specific output is not seen to necessarily require or confer movement, but merely illustrate that the component has a force enacted upon it.

Preferably, the output connector is connected to a linked crank, the linked crank being connected to at least one of the switch rail, or a linked crank connected to an output connector of a second linked crank mounting device, by linkages.

Preferably, the linked crank comprises two lever arms, the two lever arms preferably being connected by linkages to the switch rail and output connector of a second linked crank mounting device respectively.

More preferably, the linked crank is in an "L" shape, with the two lever arms at substantially 90° to each other and joined at a vertex.

Many other linked crank designs would be apparent to one skilled in the art.

As stated above, the linked crank mounting device of some embodiments according to the present invention has been designed with current systems in mind, and as such is designed to be used with linked cranks wherein one arm is connected to the neighbouring crank(s) and the other arm is connected to the switch rail. Such uses may comprise only one linked crank, or may rather comprise two, three or more linked cranks in series connected by linkages.

These linkages, as known in the art, can be very carefully designed to be able to withstand the axial loads and vibrations likely to be experienced. They can also be designed to be the right length to keep the switch rail within the correct dimensional tolerances at the respective longitudinal locations. Preferably the linkages still provide length adjustment means to enable the exact length to be altered if required. This would preferably be provided by means of a threaded section. Alternatively, this may be provided with a telescopic section. As such, all the relative lengths of the linkages, as well as their attachment locations on the linked cranks typically are carefully fixed and monitored. Some embodiments in accordance with the present invention allow these complex or costly elements to suffer less wear in use, thus reducing their servicing and replacement requirements.

Typically the linkages comprise elongated metal rods. However, other materials may become useable if the forces applied thereto are lower, such as high-strength, rigid plastics and composites.

The majority of the components disclosed in relation to some embodiments in accordance with the present invention will be strong, hard and hard-wearing. As such, most components will be made out of metal, preferably hardened or toughened steel or alloys. Other suitable materials may also include specialised plastics and composites.

Preferably the linkages are pivotally attached to the linked crank. Alternatively, the linkages may be pivotally connected to brackets, the brackets being rigidly but detachably fixed to the linked crank. The linkages should be attached to a pivot either directly to the linked crank or via a bracket to allow the components at either end to rotate relative to each other during use, without building up significant stresses in the linkages. Preferably this bracket can be loosened and slid along the linked crank so as to modify the distance between the bracket and the pivot, and hence the amount the linkage moves for a given crank rotation. Other connection types may be possible provided relative rotations and axial stresses are accounted for. Potential examples include a pin and slot or ball and socket joint.

Preferably the linkages are pivotally connected to the switch rail. This is beneficial for the same reasons as above.

Preferably the linkages are configured to ensure each linkage connection-point on the switch rail moves the correct predetermined amount. Preferably, the linkages have a threaded portion to allow the length to be adjusted if required.

Preferably, movement of the output connector is steady while the free end of the switch rail approaches a fixed stock rail. With some embodiments in accordance with the present invention, to ensure a secure locking of the end of the switch rail, points along the rail should ensure there are no sudden movements or vibrations along the rail. As such, output connectors in accordance with some embodiments of the present invention should preferably maintain a constant velocity or rotational velocity during switching.

A locking component will usually be present at the end of the switch rail, so that once the tip is in position, the lock engages with the stock rail, maintaining the tip in position. It is important that the linked cranks do not act to disturb the movement of the tip of the switch rail so as to prevent it locking in position effectively. The point machine driving the tip of the switch rail and the linked cranks work in harmony, so as to avoid any undesired bending of the rail.

To prevent any undesirable stresses in the switch rail, the entire length of the switch rail is desired to move in one harmonious, smooth and predetermined motion. The motion of specific points or entire sections can be modified and controlled by altering the linkage lengths, the linkage connection points, the piston stroke lengths and the supply of input power (for example controlling the flow of electricity, the amount and rate of pressurised fluid supplied etc) if required. This typically is a one-time setting, but may need fine tuning over time.

Further advantages could be attained by including sensing means within the system to confirm that certain points along the switch rail are located within the allowable tolerances correctly. A feedback loop could be used to control the linked cranks, ensuring the switch rail is correctly located. This again could be done mechanically or electronically.

As discussed above, some embodiments in accordance with the present invention are to be plugged into existing linked crank systems, and so it is advantageous that the attachment means, for fixing the linked crank mounting device of some embodiments according to the present invention to the surrounding area, are simple, secure and economical.

Preferably, four mounting holes are present in the top surface of the device. Preferably, these holes are machined through the entire body, so they can be bolted directly, or via a mounting plate, to the bearer (which can be a mounting block, sleeper or bracket). Preferably, these holes are located so as to be compatible with existing linked crank mounting devices, such as those that are currently used throughout the UK railway network. This offers compatibility with existing products for allowing rapid point upgrades. Thus direct replacement of existing devices is possible.

These can be located or altered as appropriate, however, depending upon the receiving medium on the ground, e.g. if pegs are needed, rather than holes for bolts.

Preferably, the attachment means comprises mechanical fixing means. Preferably the attachment means comprises four screws suitable for attachment to a railway sleeper. Alternatively the attachment means could be designed for attachment to the ground. Other potential mechanical fixing means include rivets or cam-lock clamps.

Preferably the device comprises attachment means similar to those currently used for the linked-crank supporting component. This attachment means may comprise four screws arranged in a rectangular pattern. Providing an identical arrangement can allow the so-equipped embodiments to be easily interchanged with the old design, without requiring new fixing holes or features.

Attachment means other than mechanical ones are envisaged too, including adhesives or other bonding materials.

Preferably the linked crank mounting device is driven.

Preferably, when the input terminals are disconnected, the linked crank mounting device acts as a non-driven mounting device.

Preferably, the input power is from the same power source as the point machine which drives the tip of the switch rail. Although this is not a strict requirement—the linked crank mounting device can have any of the power inputs mentioned above—it is desirable as it further simplifies the introduction of such systems into existing networks.

Preferably, a simple splitter is used before the point machine to provide power to the crank device. Alternatively the power can be fed to the crank device from the rail point machine itself. Alternatively the crank device could be supplied by its own power supply, or could run off its own portable power supply, e.g. batteries.

Preferably the input power is electrical power. Electrical power will typically be available in the vicinity of the points, and is anyway easy to transfer over long distances, and relatively inexpensive to install.

Preferably the actuator comprises an electric motor. Electric motors are relatively inexpensive, can be highly specialised in terms of size, shape and power output, and are easy to control. Modern electric motors are also becoming increasingly robust, thus surviving the environmental exposure of a track-side installation.

The torque and response speed characteristics of the motor can also be very carefully optimised for the application requirements.

The motor can be AC or DC. It is likely to be a stepper motor.

Preferably, the input terminals are connected to the motor stator, and the output connector is connected to the motor rotor. This allows the input electrical power to drive the motor when required, which can directly control the rotation of the output connection.

Gearing may be helpful to match the torque and speed output characteristics of the motor to the particular application's requirements.

The motor may be used to drive a pinion from a rack and pinion assembly. This will then provide linear motion which can be used for a linear-movement linked crank assembly, or to drive further pinions which are then attached to the output connection.

In general, any number of standard components can be used with some embodiments in accordance with the present invention, including motors, such as electrical, hydraulic or pneumatic motors. Components which transfer power and can be used to change speed and torque or force characteristics, such as gears and levers, can also be used. Likewise, assemblies which convert longitudinal motion to rotation or vice versa, such as a rack and pinion, lead or ball screw, rotary gear and offset pin and pistons, can be used.

The above components can be combined in a wide range of permutations and combinations, depending on the specific application's requirements, such as the available space, and the required speed, torque, reliability and cost characteristics. All such combinations used within a linked crank mounting device as described herein are seen as being within the scope of the present disclosure.

A small number of potential combinations will be discussed herein. It should be remembered, however, that in general the greater the number of components, the greater the potential for efficiency losses, plus the potential for heat generation and wear.

Preferably, the linked crank mounting device comprises a piston, a manifold and a hydraulic motor connected to the output connector, wherein the electric motor is connected to the power input and drives the piston, the piston pressurises hydraulic fluid which then operates the hydraulic motor via the manifold, the hydraulic motor driving the output connector.

Preferably, the hydraulic motor is a piston motor. Alternatively, the hydraulic motor is a vane motor. Further, the hydraulic motor can be a gear motor.

Preferably the input power is hydraulic power. The majority of current point machines are hydraulically powered and as such it is desirable for the linked crank mounting device also to be hydraulically powered, thus allowing it to run off the same power, preferably from the same supply, as the point machine, or even from power supplied through the point machine.

Preferably the actuator comprises at least one hydraulic piston. Preferably this piston has at least one adjustable end stop to limit its movement to within specific ranges.

Preferably, the actuator comprises at least one manifold.

Preferably, the hydraulic piston interacts with the manifold which is connected to the input terminals.

The manifold can control and regulate the flow of pressurised fluid from the input terminals to the piston chamber. As such, preferably the manifold is coupled to the input terminals. The manifold does not need to be directly coupled to the input terminals, and may be located elsewhere within the device and still regulate the pressurised fluid in the piston chambers.

Preferably the hydraulic piston interacts with a manifold connected to the input terminals.

Preferably the actuator comprises a rack and pinion.

Preferably the pinion is connected to the output connector and the rack is driven by the hydraulic piston.

Preferably the linked crank mounting device further comprises a second rack connected to a further hydraulic piston, wherein the second rack contacts the pinion diametrically opposite the first rack.

Preferably the hydraulic piston assemblies are connected to both ends of the first rack and the second rack. This provides the possibility of increased control over the position of each rack—the pistons being able to exert a positive pressure on one side, and negative pressure on the other side of the rack.

Preferably the piston or pistons have threaded end stops to control the stroke of the piston and limit its movement if required.

Preferably the hydraulic piston assemblies are anchored by structural blocks at either end of the device. Preferably the input terminals are located in one of the structural blocks. Preferably the output connection is located on the uppermost surface of the device.

The relative locations of certain components are largely arbitrary within the scope of the present disclosure. The above arrangements, however, can provide a compact design which provides convenient surfaces for locating the input terminals on, as well as providing the output connection on the uppermost surface, to facilitate connection to existing linked crank systems.

Preferably at least one of the structural blocks also functions as a manifold. The manifold may be used as a structural block to provide strength and rigidity to the device.

A further potential combination of actuation components is as described above, further comprising a hydraulic motor coupled to a lead screw or ball screw; wherein the hydraulic motor drives the rotating component of the ball screw, the laterally moving component of the ball screw is connected to and drives the rack, and the pinion is connected to the output connector.

Preferably the hydraulic motor is a piston motor. Alternatively, the hydraulic motor may be a vane motor. Alternatively, the hydraulic motor can be a gear motor.

The following are further possible assemblies:

One wherein the actuator comprises a hydraulic motor connected to the input terminals. Such a design has the benefit of being simple and involving few components. Such a design may benefit from a series of gears to match the motor torque and speed characteristics to the required characteristics.

Preferably, the hydraulic motor directly drives the output connector.

Preferably, the hydraulic motor is a piston motor. Piston motors typically provide the best sealing for high pressure applications and they typically work best in high torque, low speed, applications. They are, however, relatively complex and therefore can be expensive to manufacture and repair.

Preferably, the hydraulic motor is a vane motor. Vane motors are advantageous in high speed applications, and so will be more likely to benefit from gearing than other motor designs. Vane motors, however, are relatively simple, easy to maintain and are robust.

Preferably, the hydraulic motor is a gear motor. Gear motors are very compact, are probably the least costly of the above suggested motors, and again are suited to high speed applications and so may benefit from gearing.

Although the above specific motors have been suggested, multiple other motor designs will be suitable and apparent to a skilled reader. Any such motor used in a powered linked crank mounting device is considered to be within the scope of the present disclosure.

Preferably, the actuator comprises a lead or ball screw assembly.

Preferably, the hydraulic piston is connected to the longitudinally moving component of the screw assembly and the rotational component of the screw assembly is connected to the output connector.

Alternatively, the longitudinally moving component of the screw assembly could be coupled to the rack, with the rotational component coupled to an electric, hydraulic or pneumatic motor. With the pinion attached to the output connection, actuation of the motor drives the rack and pinion, and hence the output connection, via the ball or lead screw.

Preferably the actuator comprises a rotary gear and offset pin. As such, the rack and pinion or ball/lead screw assembly of any of the above combinations can be substituted for a rotary gear and offset pin. This is equally applicable for an electric, pneumatic or hydraulic power supply.

Preferably, the offset pin is connected to the hydraulic piston and the rotary gear is connected to the output connection.

Preferably the input power is pneumatic power.

Any discussion relating to specific components for use within the actuator assembly in relation to one power supply type (i.e. electric, hydraulic or pneumatic) applies mutatis mutandis to the other power supply types, as would be apparent to one skilled in the art. As such, in general, hydraulic pistons can be readily exchanged for pneumatic pistons with a different power supply type and electric and especially hydraulic and pneumatic motors can be used interchangeably provided the correct power format is supplied.

According to another potential aspect of the present disclosure there is provided an assembly comprising at least two interconnected linked crank mounting devices as described above, connected to at least one of the switch rails at multiple longitudinal locations.

The present disclosure thus can provide an assembly comprising at least two interconnected linked crank mounting devices, the two devices each including: an input terminal or series of input terminals; an output connector; and attachment means for rigidly attaching the linked crank mounting device relative to the railway; wherein the input terminals are for receiving input power, the output connectors are directly or indirectly mechanically linked to at least one of a switch rail or an output connector of a further linked crank mounting device, at lease one actuator applies the input power to the output connectors, the output connectors each being connected to a linked crank, and the linked cranks being connected to at least one of a) the switch rail, or b) a second linked crank connected to an output connector of a second linked crank mounting device, by linkages; the devices being connected to at least one of the switch rails at different longitudinal locations.

According to another potential aspect of the present disclosure there is provided a method for actuating switch rails, wherein a driving force is supplied to at least one linked crank connected to at least one of the switch rails at least one location displaced from a point machine.

The present disclosure can thus provide a method for actuating switch rails, comprising providing at least one crank mounting device, the device, including: an input terminal or series of input terminals; an output connector; and attachment means for rigidly attaching the linked crank mounting device relative to the railway; wherein the input terminal or terminals are for receiving input power, the output connector is directly or indirectly mechanically linked to at least one of a switch rail or an output connector of a further linked crank mounting device, and an actuator applies the input power to the output connector; the device thus being connected to at least one of the switch rails, and supplying a driving force to the at least one crank mounting device to assist with, or to drive, the rotation of a crank on the crank mounting device.

Preferably, the driving force is produced electrically. Alternatively, the driving force can be produced hydraulically. Alternatively, the driving force can be produced pneumatically.

Preferably, the driving force is actuated by a motor. Alternatively, the driving force can be actuated by a rack and pinion. Alternatively, the driving force can be actuated by a rotary gear and offset pin.

Preferably a power input to the point machine provides the driving force.

Further features of the present disclosure will now be described in greater detail, purely by way of example, with reference to the accompanying drawings in which:

DETAILED DESCRIPTION

Figure 1:
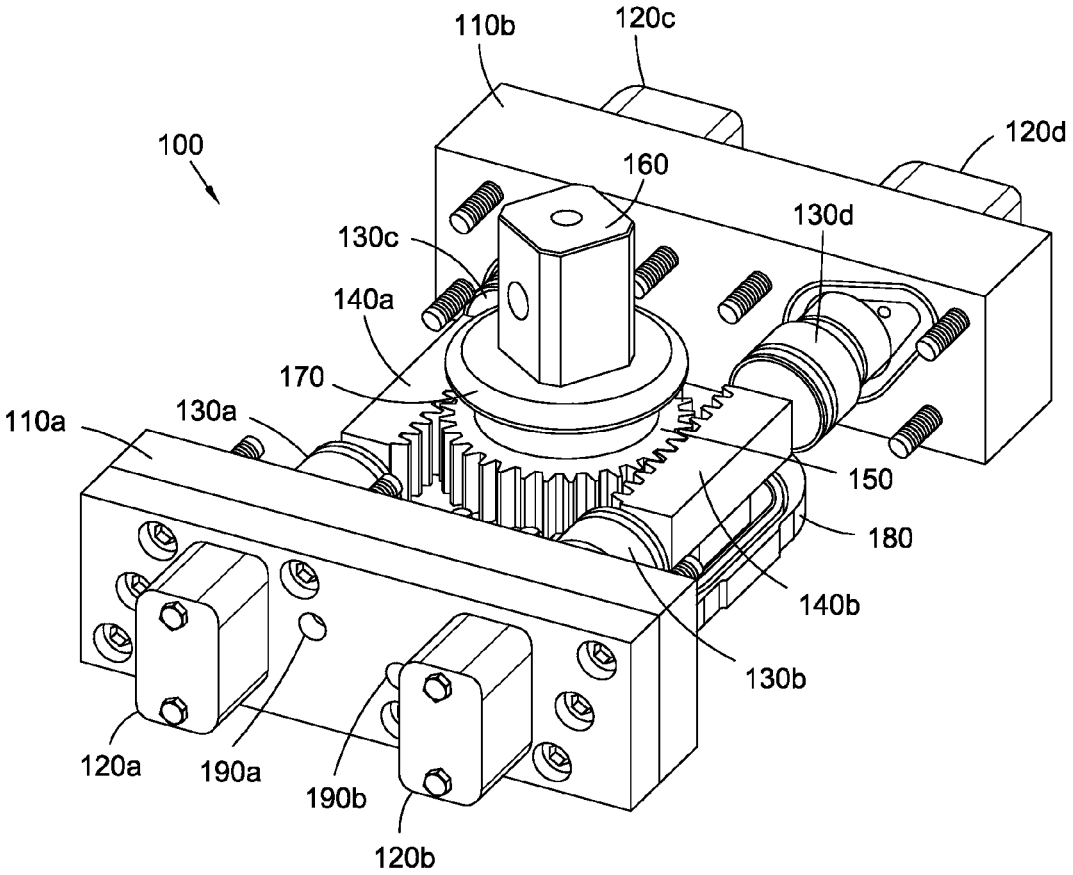
FIG. 1 is a perspective view of a first form of actuator for use with some embodiments of the present invention, with a cover removed.
Figure 2:
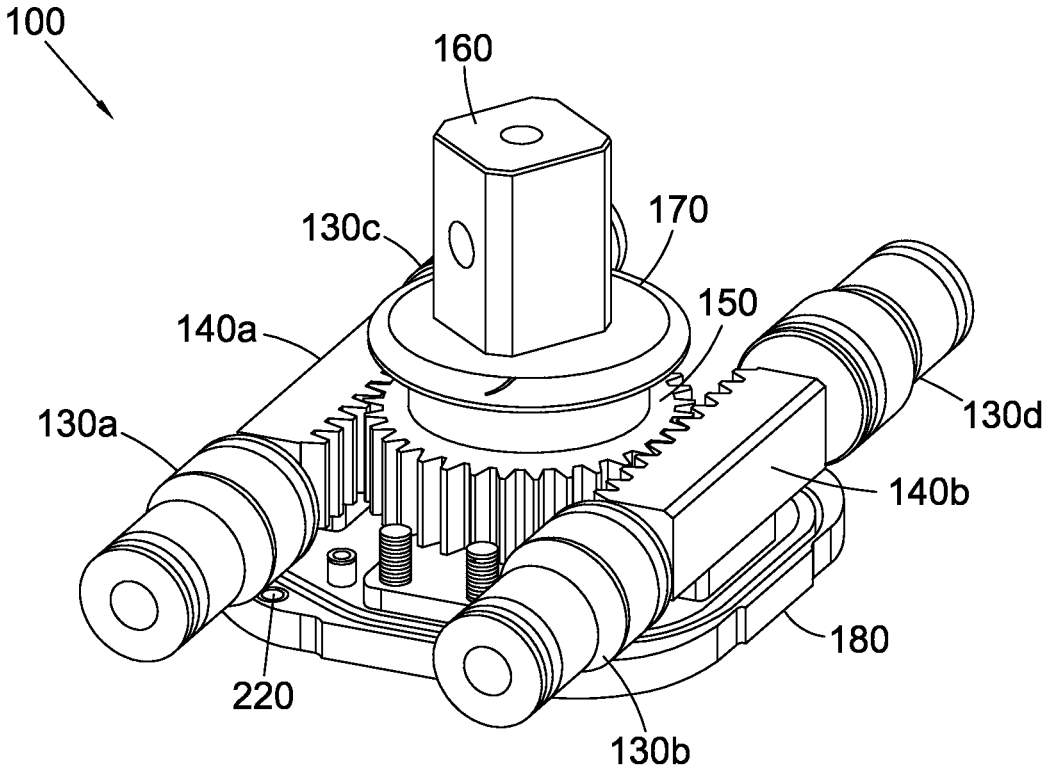
FIG. 2 is a further perspective view of the actuator of FIG. 1, but with additional components removed for clarity.

FIGS. 1 and 2 illustrate a number of components of a linked crank mounting device 100. In FIG. 1, two manifolds 110 are located in a parallel and spaced apart arrangement. In this embodiment the two manifolds are rectangular. They form the two ends of the device 100.

Each manifold houses a number of attachment bolts for securing the manifolds 110 and neighbouring components in place.

The manifolds 110 of this embodiment are made out of metal and regulate hydraulic fluid flow into pistons 130.

Extending from the end surface of each manifold 110 are two removable dust covers 120. These dust covers 120 are bolted onto the manifold 110, house the end portions of hydraulic pistons 130 during operation, and in this embodiment are located approximately a quarter of the manifold's length in from either end of the respective manifold 110. The dust covers prevent the ingress of dirt and moisture.

In this embodiment, under the dust covers is a bleed nipple to allow bleeding of the air from the hydraulic system and an adjustable stop with lock nuts for adjusting the stop position of the piston. Other arrangements are possible.

Pistons 130 extend from the inside surface of their respective manifolds 110, and are aligned with a corresponding piston 130 on the opposing manifold 110. A first piston 130*a* of the first manifold 110*a* is opposite and extends towards a first corresponding piston 130*c* of the second manifold 110*b*. A second piston 130*b* of the first manifold 110*a* is then opposite and extends towards a second corresponding piston 130*d* of the second manifold 110*b*.

Racks 140 are rigidly attached between opposing pistons 130*a*, 130*c* and 130*b*, 130*d*. Teeth are provided on both racks 140—in this embodiment on the inner face, facing the centre of the device 100.

A pinion 150 in the form of a spur gear is located between the two racks 140. In this embodiment it is arranged to have its axis of rotation sitting vertically in use. It meshes with both racks 140.

This preferred arrangement is generally symmetrical, whereby the pinion 150 is located at the centre of the device 100.

It is preferred that it sits on or adjacent to a base plate 180. The pinion 150 is free to rotate relative to the base plate 180. The base plate 180 forms a part of, and is rigidly attached to, the base of the device 100. In this embodiment, the base plate 180 sits flush with the base of the device 100 and sits on a rubber seal.

The base plate 180, in this embodiment, comprises a thick plate of metal, generally square in shape, but with radiused corners. The base plate 180 does not extend to either manifold 110*a* 110*b*, nor to either side of the device 100. As such, the base plate 180 only covers an area above which the pinion, racks and pistons interact.

In this embodiment, the base plate 180 comprises a number of bolts and bolt fittings, for attaching the pinion 150 and surrounding structural reinforcements to the base plate 180.

Referring to FIG. 2, a hole 220 is shown. Others are provided in corresponding locations under the pistons 130. These holes are used to remove the base plate 180 from the base of the device 100. Should the base plate 180 need to be removed, screws are inserted into tapped holes 220 and screwed in. As the tips of the screws protrude from the underside of the base plate 180, the base plate is forced away from the base of the device 100, allowing it to be lifted away.

Figure 3:
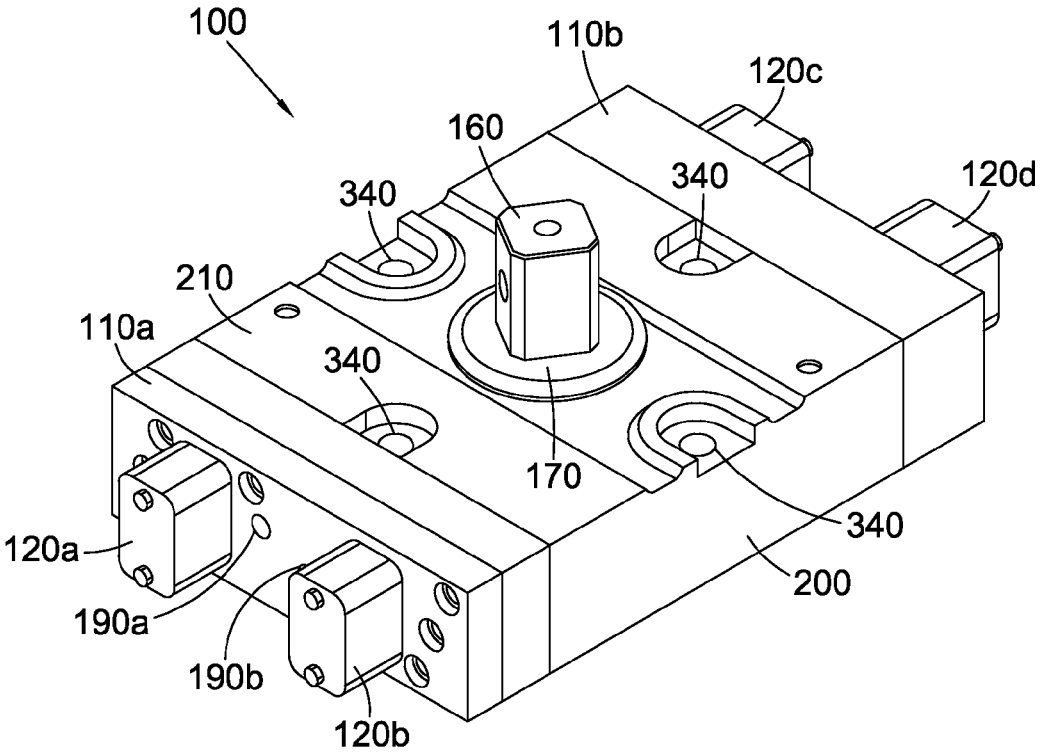
FIG. 3 is a perspective view of a another device for use with some embodiments of the present invention, such as the device of FIG. 1, but with the cover in place.

An output connector 160 is connected to the centre of the upper surface of the pinion 150. The output connector 160 extends up through the top surface of the device, as shown in FIG. 3, and is for connecting to the linked crank 230 during use.

In this preferred embodiment, the output connector 160 has a square profile with chamfered corners and as such is dimensioned so as to fit current linked cranks employed in the UK rail network. It may be changed to fit alternative known cranks, e.g. a star section, a round with a keyway, a round with a taper, or a triangular section, if appropriate.

In this embodiment, a sealing plate 170 is also provided which extends radially from the base of the output connector 160 so as to sit flush with, or on top of, the outside of a top plate or cover 210 of the device during use.

In this illustrated embodiment, the first manifold 110*a* comprises two hydraulic input terminals 190. The input terminals 190 can have supply pipes connected thereto using industry standard hydraulic pipe connections. They allow a supply of hydraulic fluid to be easily connected to the device 100 to operate the pistons 130*a-d*.

FIG. 3 shows the complete linked crank mounting device 100. The manifolds 110 can be seen at either end of the device 100. The sealing plate 170 can also be seen sitting flush with the top plate 210 around the base of the output connector 160, which extends from the centre of the top plate 210. While the top, plate and side plates are discussed as if they are separate components (and can be in some embodiments), in the present embodiment the powered crank is preferred to be machined from a solid block of steel, and so individual panels cannot be removed.

Four mounting holes 340 are present in the top surface of the device 100 of this preferred embodiment. These holes, in this embodiment, are machined through the entire body, so they can be bolted directly, or via a mounting plate, to the bearer (which can be a mounting block, sleeper or bracket). These holes are located so as to be compatible with existing linked crank mounting devices, such as those that are currently used throughout the UK railway network. This offers compatibility with existing products for allowing rapid point upgrades. Thus direct replacement of existing devices is possible. These can be located or altered as appropriate, however, depending upon the receiving medium on the ground, e.g. if pegs are needed, rather than holes for bolts, or if another different mounting method is preferred.

The input terminals 190 are still uncovered and exposed on the end of the manifold 110*a*, allowing hydraulic piping 240 to be connected and disconnected.

Figure 4:
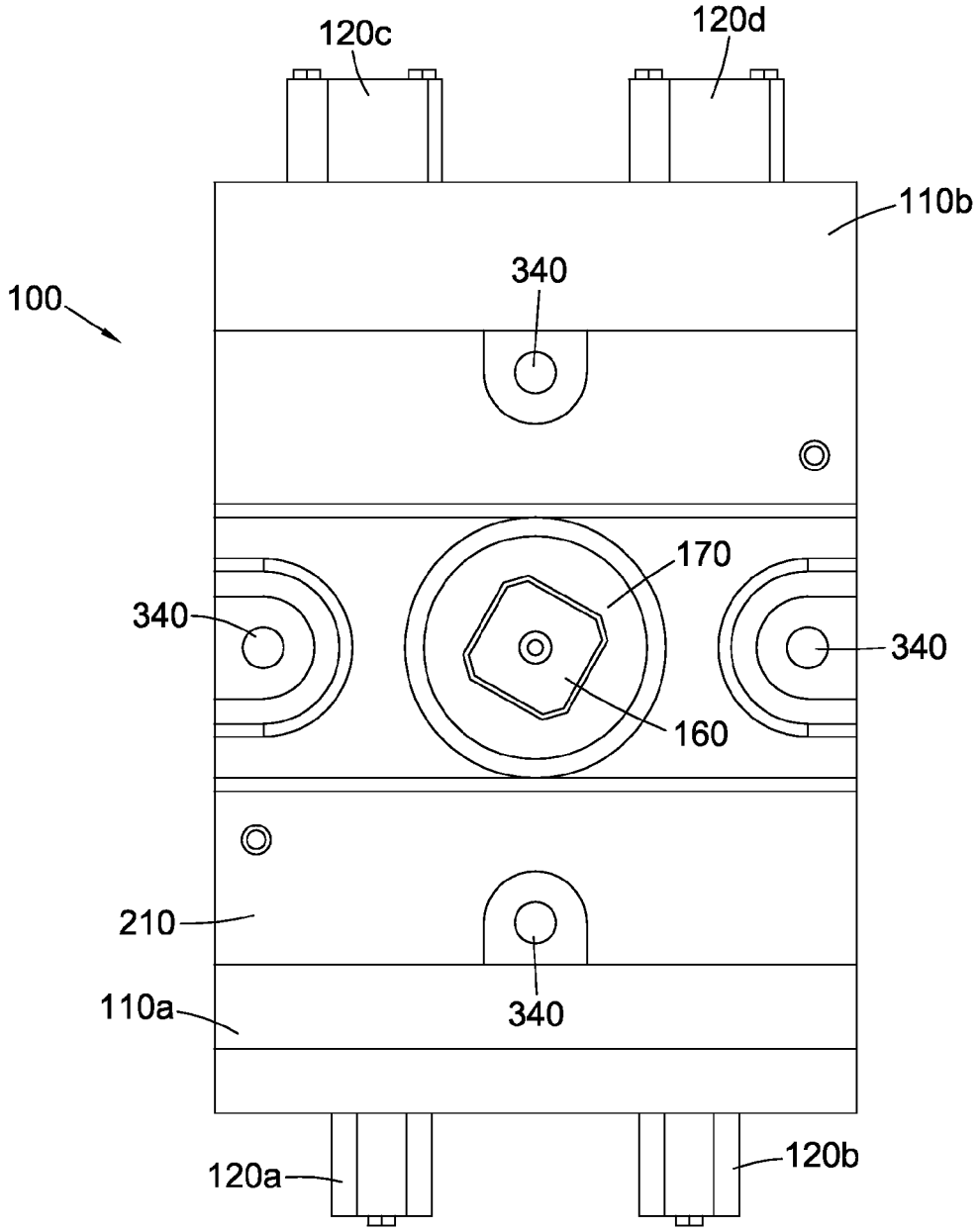
FIG. 4 is a top plan view of the device of FIG. 3.

A top view of the linked crank mounting device 100 can be seen in FIG. 4.

Figure 5:
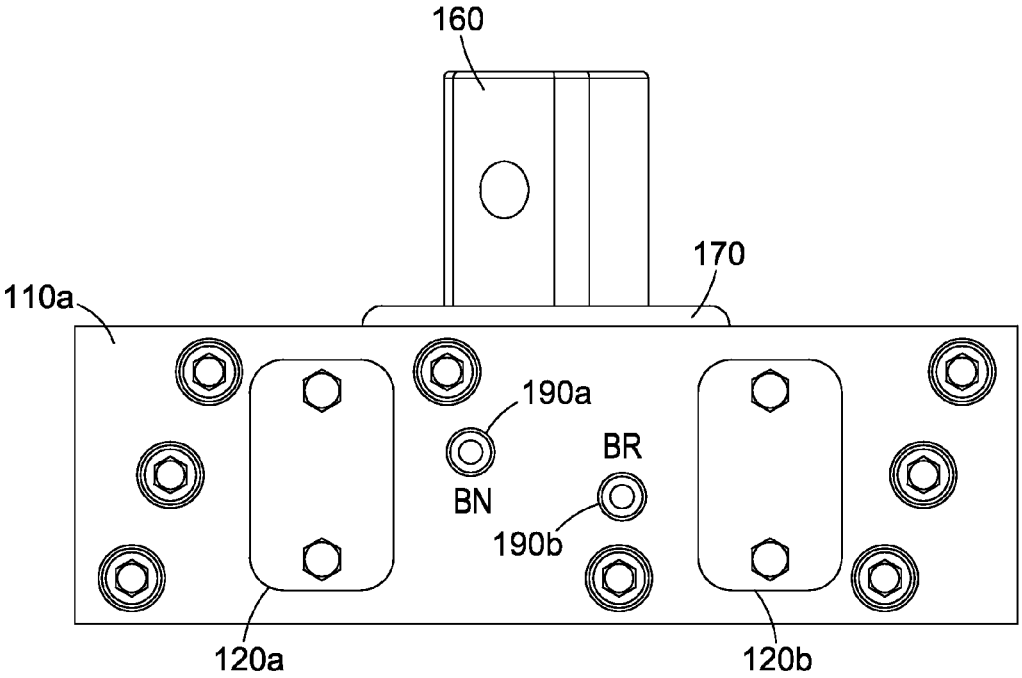
FIG. 5 is an end elevational view of the device of FIG. 3.

FIG. 5 is an end view illustrating the locations of input terminals 190*a*, 190*b*—here in the form of hydraulic hose fixing points, and the dust covers 120*a*, 120*b* each with two fixing bolts for attaching them to the manifold 110*a*. Eight manifold fixing bolts are also shown—heare cap head bolts. In this embodiment these are shown in the end of the first manifold 110*a*. Corresponding features are salso provided in the opposite end—in the second manifold, save for the hydraulic hose fixing points—they are only needed on one side (unless located elsewhere), although the choice of side is arbitrary.

Figure 4A:
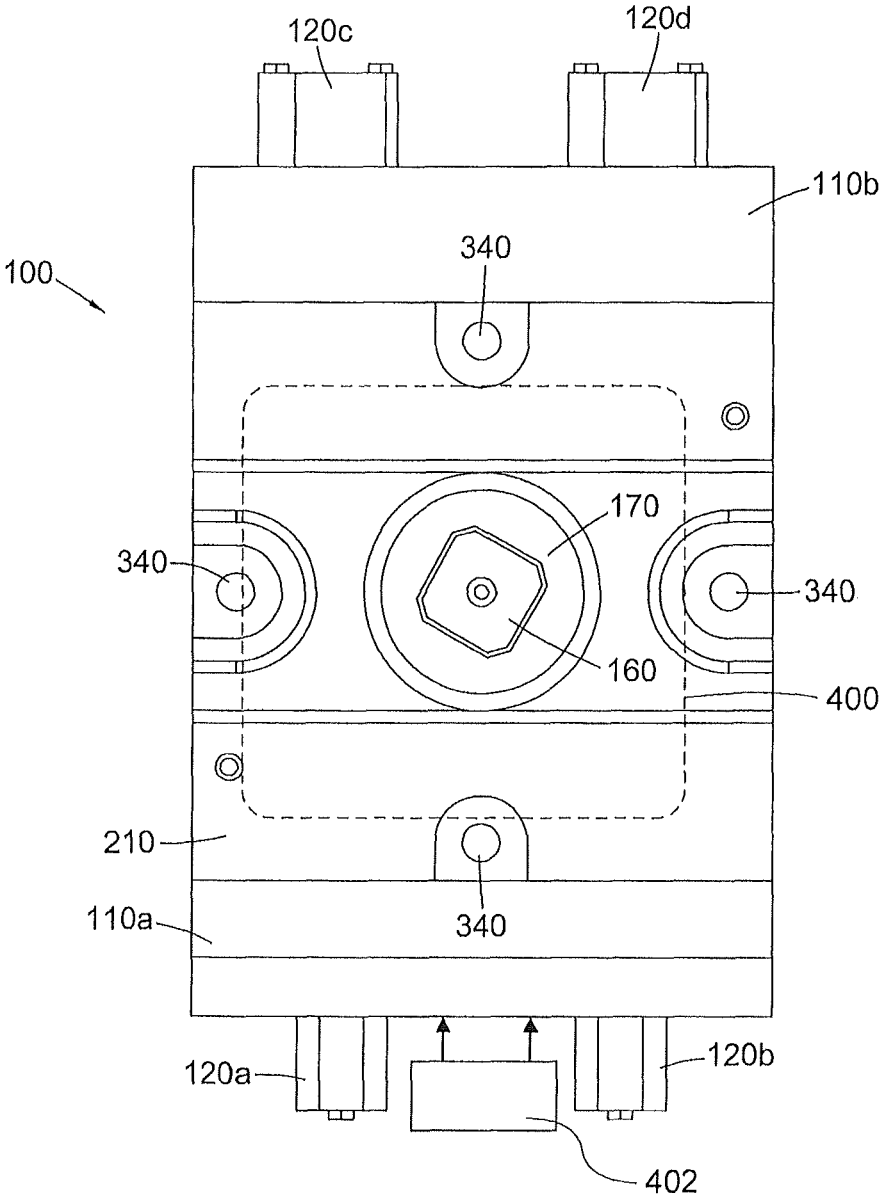
FIG. 4A is a top plan view of another embodiment of the device.

FIG. 4A is a top view of a linked crank device 100 having a lead or ball screw assembly 400. Alternatively, the device

100 can have a rotary gear and offset pin assembly 400. In some embodiments and as represented in FIG. 4A by input 402, the input power may be electrical power.

Figure 6:
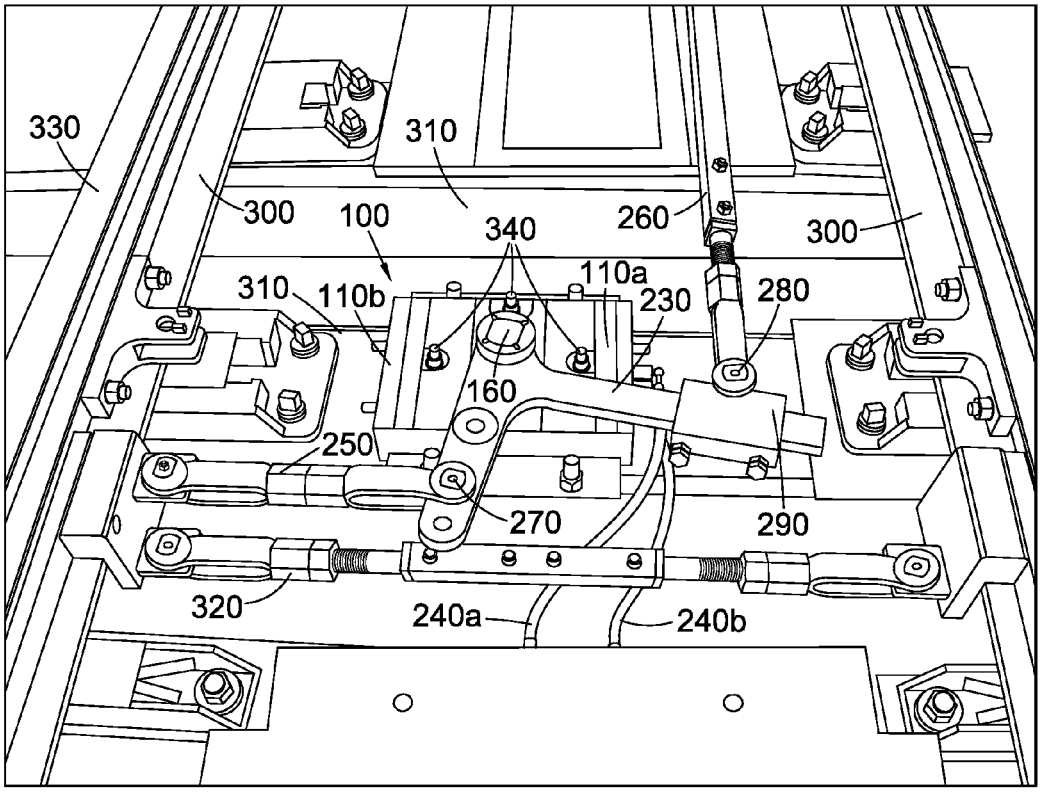
FIG. 6 is a view of another device for use with some embodiments of the present invention, installed within a linked crank system between a pair of switch rails, the view illustrating one linked crank.

In operation, the input terminals 190 are connected to hydraulic piping 240, as shown for example in FIG. 6. That piping supplies hydraulic fluid to the manifold 110*a* which in turn supplies the pistons 130.

The expansion and contraction of pairs of pistons, coupled through the rack, is coordinated so that as the first piston 130*a* on the first manifold 110*a* expands, the opposite corresponding first piston 130*c* on the opposite second manifold 110*b* contracts. The other pistons also cooperate similarly. As such, the two racks 140*a* 140*b* can be moved longitudinally in either direction using the pistons. Additionally, as both racks are coupled to opposite sides of the pinion 150, the pairs of pistons 130 on the same manifold 110 are coordinated so that as one of the pistons 130*a* 130*d* expands, the other piston 130*b*, 130*c* contracts. This ensures that the forces applied to the pinion 160 by the racks 140 apply a torque to the pinion, rather than a lateral force. Further, by opposing one another, they will not act to cancel each other out.

Referring again to FIG. 6 there is shown a linked crank mounting device installed within a linked crank system. The output connector 160 is attached to a crank 230 which in turn is connected to two linkages, one linkage 250 being connected to a switch rail 300 and the other linkage 260 being connected to a further crank up the line (not shown, but see FIG. 7 for an equivalent arrangement on a side mounted arrangement, rather than a between rail arrangement).

The crank 230, in this embodiment, is pivotally connected to both linkages 250, 260 via pivot joints 270, 280.

For the second linkage, this is achieved in this embodiment via a bracket 290 that is rigidly connected to the crank 230 and which is pivotally connected to crank linkage 260. The bracket, however, can be adjusted to vary the range of movement of the other linkage 260, dependant upon the particular arrangement of the points system.

For the first, switch rail linkage 250, however, the pivotal connection is less variable—it is in one of three potential holes in the crank arm.

Other arrangements are also known in the art for the connections between the crank 230 and the other cranks and switch rails.

In this example there are two switch rails 300 and these switch rails 300 are connected together by a tie 320. They thus move together, the crank 230 thus moving both switch rails in unison.

A stock rail 330 can also be seen—outside the switch rail 300. The linked crank mounting device 100 is rigidly attached to one of the railway sleepers 310, using the same fittings at the linked crank mounting devices of the prior art. That sleeper is one of the sleepers for the stock rail. However, other ground mounting arrangements are also useable, e.g. a separate sleeper, or a fixed mounting pad such as a concrete pad.

In the position shown in FIG. 6, the switch rails 300 are in one of their active positions, whereby the left (as viewed in the figure) switch rail 300 is flush against the stock rail 330, and a gap is present to the right of the right switch rail 300. When it is desired to move the switch rails 300 back to the right, hydraulic fluid in hydraulic piping 240 is pressurised to both the point machine (not shown) and the linked crank mounting device 100. This hydraulic fluid, controlled by the manifolds 110 pressurises the pistons 130 exerting an anticlockwise torque (when viewed from above) on the output connector 160 via the racks 130 and pinion 150. The torque applied by the linked crank mounting device 100 can thus serve to reduce the amount of work that the point machine has to do, which work previously would have had to have been produced through the various linkages, with all their inherent inefficiencies and energy losses (and the resulting wear). The work needed to be done by the points machine is thus reduced or more appropriately distributed.

It should also be observed that in this embodiment, when the hydraulic piping 240 is disconnected from the device, and the linked crank mounting device becomes free-moving, that device will instead act as a standard non-powered linked crank mounting device. It can thus be installed prior to the provision of the power source therefor.

Figure 7:
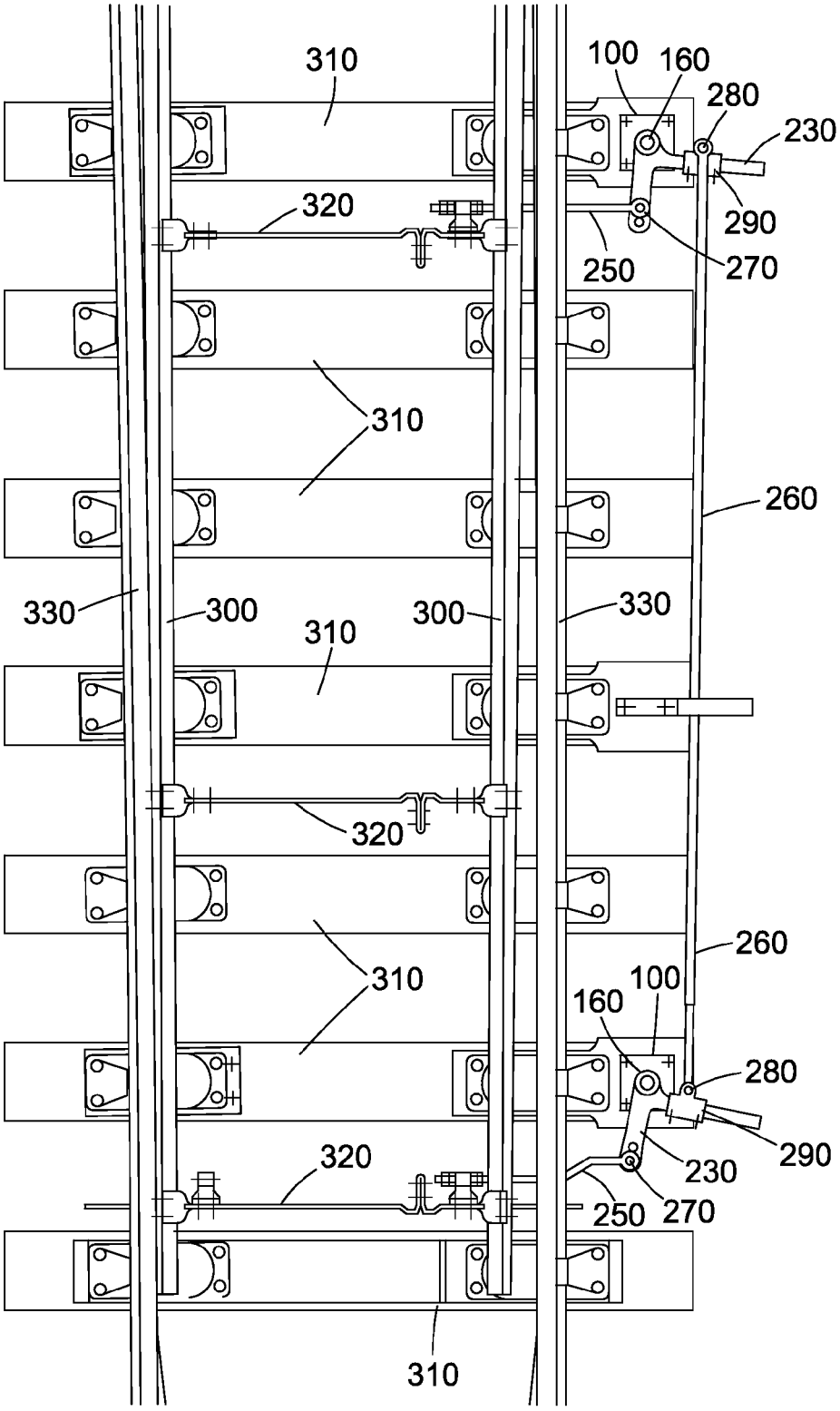
FIG. 7 is a partial schematic view of an alternative linked crank system, illustrating two linked cranks to the side of the rails, rather than between the rails.

Referring next to FIG. 7 there is shown a partial schematic of a linked crank system with two linked cranks 230. The hydraulic piping 240 is not shown in this figure. Additionally, the linked cranks 230 have been moved out from the centre of the tracks, to sit on railway sleepers 310 to the side of the stock rails 330.

The crank linkage 260 can be seen to extend from the first, lower crank 230, to one of the arms of the upper crank 230. The importance of accurately attaching bracket 290 to the crank is apparent from this as the linkage needs to be attached to a different location on the upper crank 230, compared to the lower crank 230. This is to ensure that the proportion of rotation of the upper crank 230 compared to the lower crank 230 matches the required proportion of latitudinal movement of the switch rail 300 adjacent the upper crank 230 compared to adjacent the lower crank 230. This is as known in the art for non powered cranks.

Figure 8:
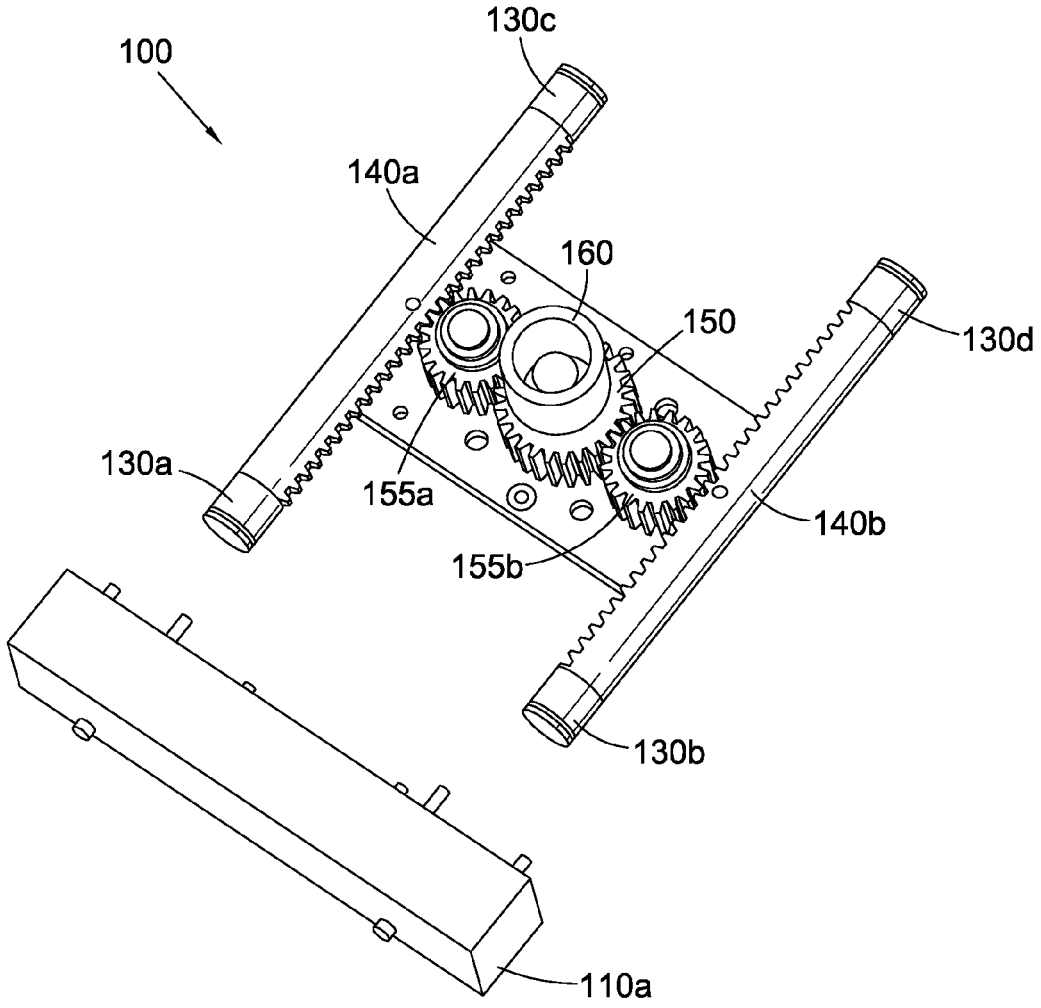
FIG. 8 is a perspective view of various components of a further possible embodiment of the present disclosure.

Finally FIG. 8 illustrates some of the moving components of further embodiments according to the present invention. As with the first set of potential embodiments, FIG. 8 depicts a manifold 110*a* housing two pistons 130*a* 130*b*, each attached to the end of a rack 140 running perpendicular to the inside face of the manifold 110*a*, with two further pistons 130*c* 130*d* on the other end of each rack 140. However, instead of a single pinion 150, the embodiment of FIG. 8 employs a central pinion 150, flanked on either side by a further pair of spur gears, acting as secondary gears 155. These secondary gears 155 mesh the central pinion 150 at diametrically opposite points on the pinion, and mesh with the racks 140 at points diametrically opposite where they mesh with the pinion 150. As such, these secondary gears 155 provide a gearing effect to modify the torque and speed characteristics of the output connector 160, as well as reverse the torque direction of the output connector 160 relative to the rack 140 force direction.

An alternative arrangement might be to have work gears in the sides, which rotate about their axes, which in turn rotate the spur gears or pinion. For that an electrical motor may be preferred.

The present disclosure therefore provides a linked crank mounting device for use with a switch rail, comprising: an input terminal or series of input terminals; an actuator; an output connector; and attachment means for rigidly attaching the linked crank mounting device relative to the railway; wherein the input terminal or terminals are for receiving input power, the output connector is directly or indirectly mechanically linked to at least one of a switch rail or an output connector of a further linked crank mounting device, and the actuator applies the input power to the output connector.

It should be appreciated that the invention has been described above purely by way of example. However, modifications in detail may be made to the invention as limited purely by the claims appended hereto.

What is claimed is:

1. A linked crank mounting device for use with a switch rail, comprising:

an input terminal or series of input terminals;

an actuator;

an output connector; and attachment means located closer to the output connector than the input terminal or series of input terminals are located to the output connector, the attachment means for rigidly attaching the linked crank mounting device relative to a railway;

wherein the input terminal or terminals are for receiving input power, the output connector is directly or indirectly mechanically linked to at least one of a switch rail or an output connector of a further linked crank mounting device, and the actuator applies the input power to the output connector.

2. A linked crank mounting device according to claim 1, wherein the output connector has a rotational output.

3. A linked crank mounting device according to claim 2, wherein the output connector is connected to a linked crank, the linked crank being connected to at least one of the switch rail, or a second linked crank connected to an output connector of a second linked crank mounting device, by linkages.

4. A linked crank mounting device according to claim 1, where movement of the output connector is steady while the free end of the switch rail approaches a fixed stock rail.

5. A linked crank mounting device according to claim 1, wherein the attachment means comprises four screws or bolts suitable for attachment to a railway sleeper.

6. A linked crank mounting device according to claim 1, wherein the input power is from the same power source as a point machine which drives the tip of the switch rail.

7. A linked crank mounting device according claim 1, wherein the input power is electrical power.

8. A linked crank mounting device according to claim 1, wherein the input power is hydraulic power.

9. A linked crank mounting device according to claim 8, wherein the actuator comprises at least one hydraulic piston.

10. A linked crank mounting device according to claim 9, wherein the actuator further comprises a rack and pinion, the pinion being connected to the output connector and the rack being driven by the hydraulic piston.

11. A linked crank mounting device according to claim 10, further comprising a second rack connected to a further hydraulic piston, wherein the second rack contacts the pinion diametrically opposite the first rack.

12. A linked crank mounting device according to claim 8, wherein the actuator comprises at least one manifold.

13. A linked crank mounting device according to claim 12, wherein the input terminals are located in the manifold.

14. A linked crank mounting device according to claim 8, wherein the actuator comprises a hydraulic motor connected to the input terminals.

15. A linked crank mounting device according to any of 1, wherein the actuator comprises a rack and pinion.

16. A linked crank mounting device according to claim 1, wherein the actuator comprises a lead or ball screw assembly.

17. A linked crank mounting device according to claim 1, wherein the actuator comprises a rotary gear and offset pin.

18. A linked crank mounting device according to claim 1, wherein the input power is pneumatic.

19. An assembly comprising at least two interconnected linked crank mounting devices, the two devices each comprising:

an input terminal or series of input terminals;

an output connector; and attachment means located closer to the output connector than the input terminal or series of input terminals are located to the output connector, the attachment means for rigidly attaching the linked crank mounting device relative to a railway;

wherein the input terminals are for receiving input power, the output connectors are directly or indirectly mechanically linked to at least one of a switch rail or an output connector of a further linked crank mounting device, at least one actuator applies the input power to the output connectors, the output connectors each being connected to a linked crank, and the linked cranks being connected to at least one of a) the switch rail, or b) a second linked crank connected to an output connector of a second linked crank mounting device, by linkages;

the devices being connected to at least one of the switch rails at different longitudinal locations.

20. A method for actuating switch rails, comprising providing at least one crank mounting device, the device, comprising:

an input terminal or series of input terminals;

an output connector; and attachment means located closer to the output connector than the input terminal or series of input terminals are located to the output connector, the attachment means for rigidly attaching the linked crank mounting device relative to a railway;

wherein the input terminal or terminals are for receiving input power, the output connector is directly or indirectly mechanically linked to at least one of a switch rail or an output connector of a further linked crank mounting device, and an actuator applies the input power to the output connector;

the device thus being connected to at least one of the switch rails, and supplying a driving force to the at least one crank mounting device to assist with, or to drive, the rotation of a crank on the crank mounting device.

* * * * *